US005895300A

United States Patent [19]

Borrelli

[11] Patent Number: 5,895,300

[45] Date of Patent: Apr. 20, 1999

[54] WATER RESCUE DEVICE

[76] Inventor: Thomas J. Borrelli, 191 N. Union Ave., Landsdowne, Pa. 19050

[21] Appl. No.: 08/986,442

[22] Filed: Dec. 8, 1997

[51] Int. Cl.[6] ..... B63C 9/26

[52] U.S. Cl. ..... 441/85

[58] Field of Search ..... 441/84, 85, 80, 441/82; 124/26, 27; 24/115 R

[56] References Cited

U.S. PATENT DOCUMENTS

| | | | |
|---|---|---|---|
| 3,094,110 | 6/1963 | Ryan | 124/27 |
| 4,505,179 | 3/1985 | Nelson et al. | 441/85 |
| 4,541,402 | 9/1985 | Winters | 124/27 |
| 4,661,077 | 4/1987 | Griffith et al. | 441/84 |
| 4,799,906 | 1/1989 | Perkins, Jr. | 441/85 |

*Primary Examiner*—Sherman Basinger
*Attorney, Agent, or Firm*—Duane Morris & Heckscher LLP

[57] ABSTRACT

A water rescue device is provided which includes a spring loaded firearm. The firearm includes a barrel, a shoulder stock and a trigger. Situated within the barrel is a spring. An aerodynamic floatation device is adapted to be releasably secured to one end of the spring. A supply of safety line has one end secured to the spring loaded fire arm and a second end secured to the floatation device. The spring is adapted to be releasably locked in an extended position so that when the trigger is depressed, the restoring forces of the spring cause the floatation device to be propelled into the air carrying the supply line therewith.

20 Claims, 2 Drawing Sheets

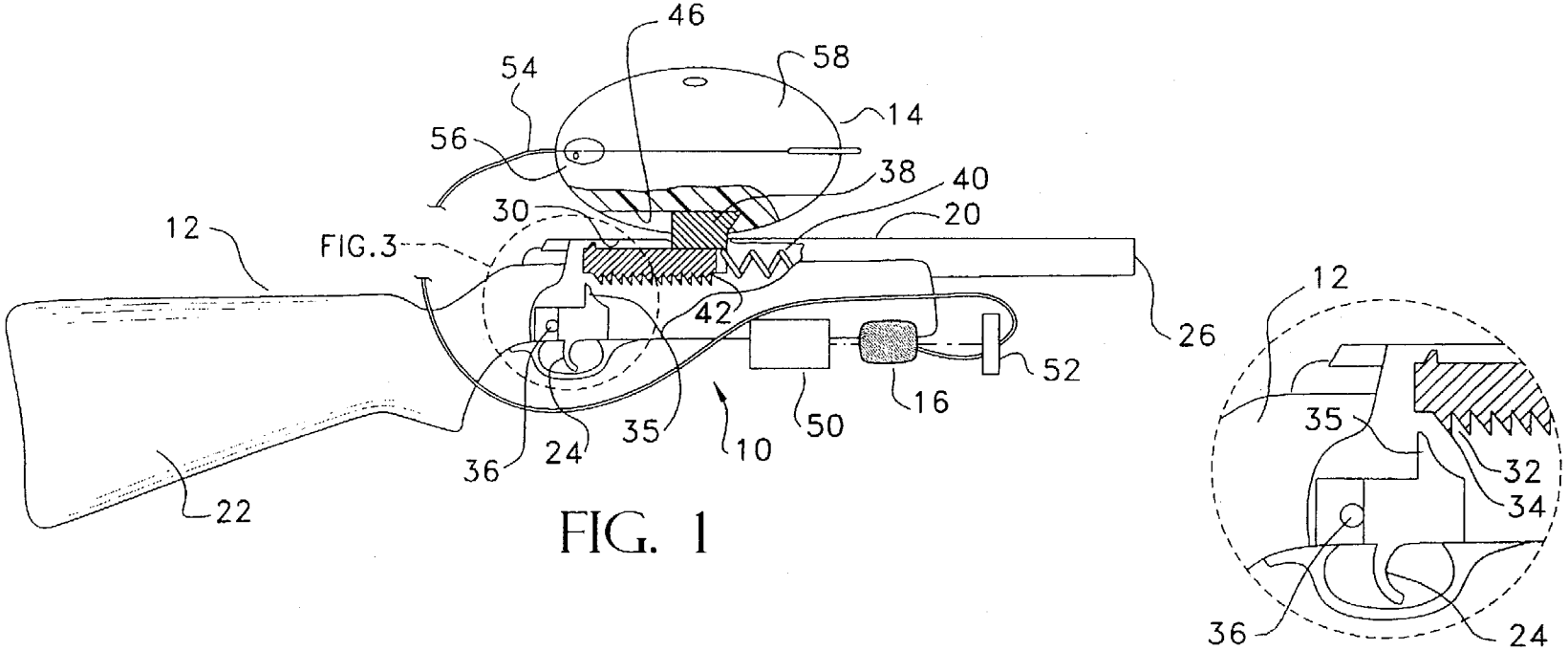
FIG. 1
FIG. 3
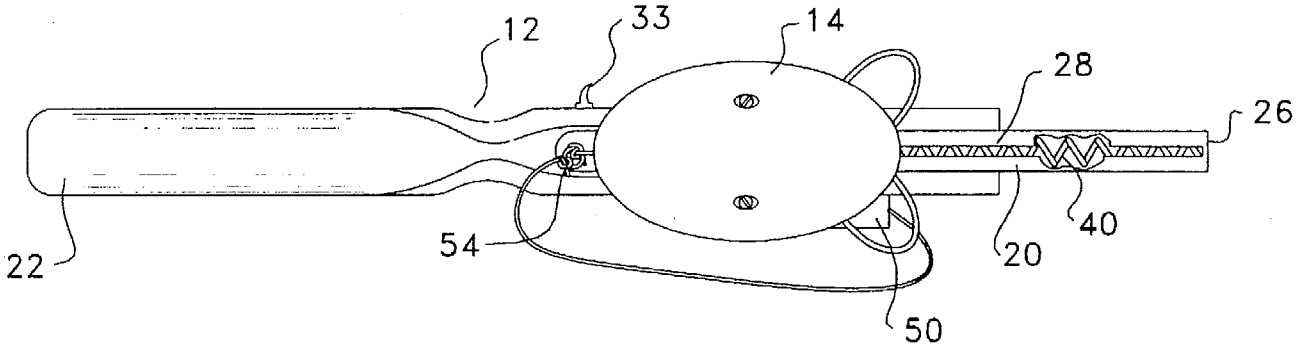
FIG. 2

WATER RESCUE DEVICE

FIELD OF THE INVENTION

This invention relates to a water rescue device and, more particularly, to such a device which is adapted to send a floatation device, which has a life line secured to one end thereof, to a person in distress who is located a substantial distance from the site of the deployment.

BACKGROUND OF THE INVENTION

One of the most dangerous of all emergency rescues is the ice water rescue. This type of rescue typically places both the rescuer and victim in danger.

An existing method of rescuing a person who has fallen into a frozen body of water is to throw a rope or safety line, which preferably has a floatation device secured to one end, to the distressed person. This method has several drawbacks associated therewith. For example, a significant amount of time is wasted as the rescuer attempts to accurately throw the rope to the distressed person. A further problem is that the person who has fallen into the ice water quickly begins to suffer the effects of hypothermia and may have trouble maintaining a grip on the rope or line that has been thrown to him or her.

Another existing method utilized to save a person who has fallen into a frozen body of water involves positioning one or more ladders on the ice so that a rescuer can crawl across the frozen body of water and reach the distressed person. This method is commonly used by members of the fire department. A disadvantage associated with this method is that it is rather dangerous since the ice could unexpectedly crack thereby causing the rescuer to fall into the same frozen body of water as the person he or she is attempting to rescue.

In recognition of the drawbacks associated with prior rescue methods, devices have been developed which are designed to propel a life line to a drowning victim located a substantial distance from the launching site so that the rescuer can pull the victim to safety without the rescuer encountering any risk. See, for example, U.S. Pat. Nos. 3,486,178, 3,496,580, 4,644,930, 4,799,906, 5,546,863, and 5,584,736. These patents disclose various gun firing devices which can launch a floatation device through the air.

However, none of the devices disclosed in these patents includes means associated with the floatation device to securely lock the floatation device to the victim. Such locking means are especially important in instances where the temperature of the water into which the victim has fallen is under 60° F. since hypothermia may set in and the victim may not be able to hold onto the floatation device for the time required to pull him or her to safety.

Further, the devices disclosed in the above-referenced patents do not include means for readily mounting the floatation device to the gun. Such devices also typically require replacement parts after repeated use.

SUMMARY OF THE INVENTION

The present invention is designed to overcome the deficiencies of the prior art discussed above. It is an object of the present invention to provide a water rescue device which is adapted to securely engage the wrists of a person in distress.

It is a further object of the invention to provide such a device which is relatively easy and inexpensive to manufacture.

It is yet another object of the invention to provide a water rescue device that can be used over and over again without requiring replacement parts.

In accordance with the illustrative embodiments, demonstrating features and advantages of the present invention, there is provided a water rescue device which includes a spring loaded firearm. The firearm includes a barrel, a shoulder stock and a trigger. Situated within the barrel is a spring. An aerodynamic floatation device is adapted to be releasably secured to one end of the spring. A supply of safety line has one end secured to the spring loaded fire arm and a second end secured to the floatation device. The spring is adapted to be releasably locked in an extended position so that when the trigger is depressed, the restoring forces of the spring cause the floatation device to be propelled into the air carrying the supply line therewith.

Other objects, features and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred, it being understood that the invention is not intended to be limited to the precise arrangements and instrumentalities shown.

FIG. 1 is a side plan view of a water rescue device with a supply of safety line shown exploded from its container;

FIG. 2 is a top plan view of the water rescue device;

FIG. 3 is an enlarged side plan view of the trigger mechanism, and

DETAILED DESCRIPTION OF THE INVENTION

Figure 4:
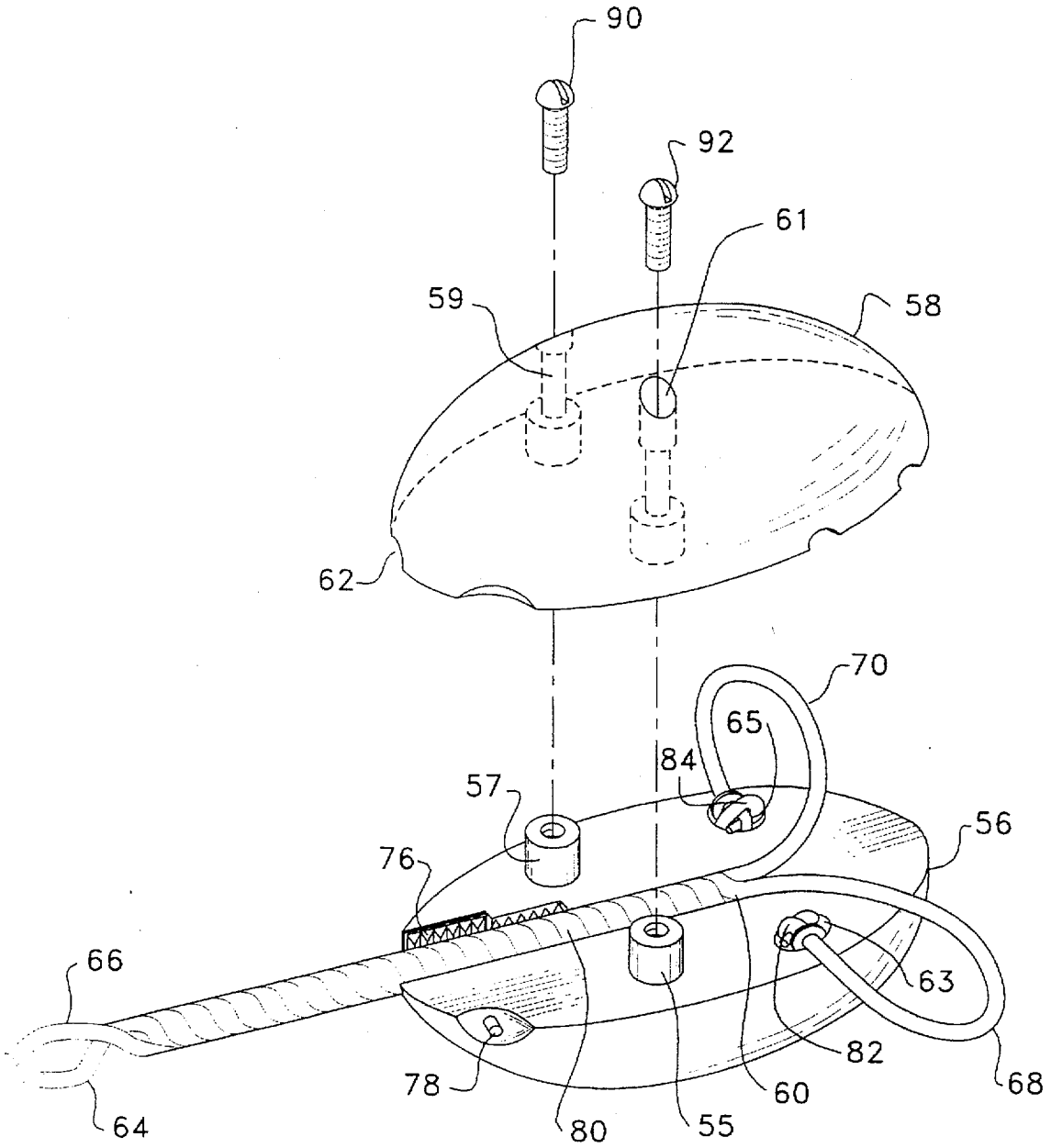
FIG. 4 is an exploded perspective view of the floatation device of the present invention.

Referring now to the drawings in detail wherein like reference numerals have been used throughout the various figures to designate like elements, there is shown in FIGS. 1 and 2 a water rescue device constructed in accordance with the principles of the present invention and designated generally as 10.

The water rescue device of the present invention essentially comprises a spring loaded firearm 12, an aerodynamic floatation device 14 which is adapted to be launched through the air, and a supply of safety line 16 which has one end secured to the firearm 12 and an opposite end secured to the floatation device 14.

In the preferred embodiment, the firearm 12 includes a barrel 20, a shoulder stock 22 and a trigger 24. The barrel 20 includes a muzzle 26 and preferably has an elongated groove 28 formed along the length thereof (FIG. 2). A ratchet 30 is mounted for axial movement along the length of the barrel 20 of the firearm 12. The ratchet 30 includes a plurality of teeth and a plurality of notches shown by way of example at 32 and 34, respectively, in FIG. 3. Each of the notches in the ratchet is situated between two adjacent teeth. A gripping member 33 extends outwardly from ratchet 30 and outwardly from the firearm 12 through and an elongated groove formed in the side thereof (FIG. 2).

A pawl 35 extends from the trigger 24 and is adapted to extend into one of the notches 34 and engage one of the teeth 32. The trigger 25 and associated pawl 35 are mounted for pivotal movement about pin 36 as more fully described below.

Extending upwardly from the ratchet and through the groove 28 in the barrel 20 of the firearm 12 is a notch engaging segment 38 (FIG. 1). Situated within the barrel 20 is a spring 40 which has one end fixedly secured adjacent the muzzle 26 and an opposite end 42 secured to the notch engaging segment 38.

In the preferred embodiment, a container 50, which includes a removable lid 52, is mounted to the firearm 12 as shown in FIG. 1. The supply of line 16 is preferably positioned within the container. One end 54 of the supply of line is positioned through an opening in the lid 52 of the container 50. The end 54 of the supply of line 16 is secured to one end of the floatation device 14.

Referring to FIG. 4, a preferred aerodynamic flotation device 14 is shown which comprises first and second half segments 56 and 58, respectively. Each half segment includes a planar surface and an arcuate surface. The segments are adapted to mate with one another to form a football-shaped floatation device. Each of the half segments is preferably comprised of a rigid polymeric material and includes a Y-shaped channel 60 and 62, respectively, formed in the planar surface thereof. Half segment 56 includes a pair of opposing recessed portions 63 and 65 formed therein. Similarly, half segment 58 includes a pair opposing recessed portions formed therein.

Further, half segment 56 preferably includes two projections 55 and 57 extending outwardly from the planar surface thereof. Each of the projections includes a threaded opening formed therein. Half segment 58 includes two screw holes 59 and 61 which are each designed to fit over a corresponding one of the projections 55 and 57 as more fully described below.

In the preferred embodiment, a spring biased elongated bar member 76 is mounted in the channel 60 of half segment 56 adjacent one end thereof. The bar member 76 includes a plurality of teeth and a plurality of notches. A spring biased elongated pin member 78 is slidably mounted through the half segment 56. An end of the pin member is adapted to extend into the channel 60 when force is applied to the opposite end thereof against the restoring forces of the associated spring (not shown).

The supply of line 16 is preferably comprised of two intertwined lines 64 and 66. Each of the lines includes a diverging end portion 68 and 70, respectively. Each of the diverging end portions preferably terminates in a knot 82 and 84.

A fixed bar member 80 is secured to the intertwined lines 64 and 66. Fixed bar member 80 includes a plurality of teeth and a plurality of notches. The teeth of fixed bar member 80 are adapted to frictionally engage the notches in spring biased bar 76 member as more fully described below.

In the preferred embodiment, the intertwined lines 64 and 66 are partially positioned in channel 60 of half segment 56 as shown in FIG. 4. Each diverging end portion, 68 and 70, is preferably formed in a loop so that it can extend from a side of the half segment 56. Each knot, 82 and 84 is positioned in a corresponding recessed portion 63 and 65. Each loop defines an opening. The half segment 58 is positioned on top of half segment 56 so that the Y-shaped channels, 60 and 62, in each of the segments overlie one another to define a Y-shaped tunnel. The two half segments are preferably secured to one another by two screws 90 and 92 which are each positioned through a corresponding screw hole 59 and 61 in half segment 58, and threaded into a threaded opening in a corresponding projection 55 and 57. It should be noted that the two half segments can be secured to one another in a variety of different ways.

The openings, defined by the loops, can be enlarged or reduced by either pushing the intertwined lines 64 and 66 into the floatation device 14 or by pulling the lines away from the same.

In order to facilitate an understanding of the principles associated with the foregoing device, its operation will now be briefly described. A user grasps gripping member 33 and pulls the same in order to extend spring 40 a predetermined amount. More specifically, the further the person to be rescued is from the rescuer, the further the spring must be extended so that the restoring force is sufficient enough to propel the floatation device the requisite distance. As the gripping member 33 is pulled back, the teeth 32, which extend from ratchet 30, contact the pawl 35. The pawl is inserted into and engages one of the teeth 32 to restrict movement of the ratchet 30 as the same is pulled back and sufficiently extended.

Thereafter, the floatation device 14 is positioned atop the firearm 12 in such a manner that the notch engaging segment 38 engages the notch 46 in the floatation device 14. The user then pulls back on the trigger 24 in order to allow the pawl 35 to pivot about pin 36 and move out of the notch in the ratchet 30. The restoring forces of the spring 40 causes the ratchet 30 and notch engaging segment 38, which is connected thereto, to move axially along the length of the barrel 20 of the firearm 12. Once the notch engaging segment 38 reaches the muzzle 26 of the barrel it is immediately brought to a halt thereby causing the floatation device, and the supply of line attached thereto, to be propelled toward the person in distress.

The victim then grasps the floatation device 14 and inserts his or her hands through the loops formed by the diverging end portions 68 and 70 of the lines 64 and 66. The victim then signals the rescuer to pull him or her ashore. As the victim is pulled in, the openings, defined by each of the loops, are tightened around the wrists of the victim. The loops are locked in place when the teeth in the fixed bar member 80 engage the notches in the spring biased bar member 76. After the victim is pulled to safety, his or her wrists are freed by pressing the spring loaded pin member 78 so that a portion of the intertwined lines is forced against the spring biased bar member 76 and the same is detracted thereby causing the teeth of fixed bar member 80 to be disengaged from the notches in spring biased bar member 76. This allows the intertwined lines 64 and 66 to be pushed inwardly so that the opening in the loops are enlarged.

The present invention may be embodied in other specific forms without departing from the spirit or essential attributes thereof and accordingly reference should be made to the appended claims rather than the foregoing specification as indicating the scope of the invention.

What is claimed is:

1. A water rescue device comprising;

a spring loaded firearm including a barrel, a shoulder stock and a trigger means;

a spring situated within said barrel and extending along the length thereof, said spring having two opposing ends;

an aerodynamic floatation device;

a supply of safety line having first and second ends, said first end being secured to said spring loaded fire arm, said second end being secured to said floatation device;

securing means being secured to one end of said spring; said securing means being adapted to releasably secure said floatation device to said one end of said spring, and locking means associated with said trigger means for releasably locking said spring in an extended position against the restoring forces of the same so that when said trigger means is depressed said restoring forces of said spring causes said floatation device to rapidly move along the length of said barrel and be propelled into the air carrying said second end of said supply of safety line therewith.

2. The water rescue device of claim 1 wherein said barrel has an elongated groove extending along the length thereof and said floatation device includes a notch formed in the bottom thereof, said securing means extending upwardly through said elongated groove in said barrel and being adapted to releasably engage said floatation device.

3. The water rescue device of claim 2 wherein said floatation device is football-shaped.

4. The water rescue device of claim 3 wherein said floatation device is comprised of a rigid polymeric material.

5. The water rescue device of claim 1 wherein said locking means comprises a ratchet and a pawl, said ratchet including a plurality of teeth and a plurality of notches, each of said notches being located adjacent two of said teeth, said pawl extending from said trigger means, said pawl adapted to move from a first position, wherein said pawl extends into one of said notches and frictionally engages one of said teeth, to a second position, wherein said pawl is positioned out of said notch.

6. The water rescue device of claim 1 further including an elongated container secured to said barrel, said container having said first end of said supply of line secured therein and said second end of said supply line extending outwardly therefrom.

7. The water rescue device of claim 1 wherein said floatation device comprises:

an aerodynamic floatation device having a Y-shaped tunnel therein;

first and second lines being partially positioned within said tunnel of said floatation device, each of said lines including a diverging end portion, each of said diverging end portions being positioned in a loop and extending outwardly from opposing sides of said floatation device, each of said diverging end portions further terminating in an end fixedly secured within said floatation device, each of said loops defining an opening, and means for enlarging and reducing the diameter of said opening in each of said loops.

8. A water rescue device comprising:

an aerodynamic floatation device having a Y-shaped tunnel therein;

first and second lines being partially positioned within said tunnel of said floatation device, each of said lines including a diverging end portion, each of said diverging end portions being placed in a loop and extending outwardly from opposing sides of said floatation device, each of said diverging end portions further terminating in an end fixedly secured within said floatation device, each of said loops defining an opening, and means for enlarging and reducing the diameter of said opening in each of said loops.

9. The water rescue device of claim 8 wherein said floatation device is comprised of a rigid polymeric material.

10. The water rescue device of claim 9 wherein said floatation device is football-shaped.

11. The water rescue device of claim 8 wherein said enlarging an reducing means comprises each of said lines being slidably positioned within said floatation device so that said openings in said loops are reduced as said lines are pulled outwardly from said floatation device and said openings in said loops are enlarged as said lines are pulled inwardly toward said floatation device.

12. The water rescue device of claim 8 further including locking means for locking said loops in a fixed position.

13. The water rescue device of claim 12 wherein said locking means includes:

a fixed bar member fixedly secured to at least one of said lines, said fixed bar member including a plurality of teeth and a plurality of notches, and a spring biased bar member mounted in said floatation device, said spring biased bar member including a plurality of teeth and a plurality of notches, each of said notches positioned adjacent two of said teeth;

said teeth in said fixed bar member being adapted to engage said notches in said spring biased bar member.

14. The water rescue device of claim 13 further including means from releasing said fixed bar member from said spring biased member.

15. A water rescue device comprising:

a first segment having a planar surface and an arcuate surface;

a second segment having a planar surface and an arcuate surface;

said first and second segments each having a Y-shaped channel located in said planar surfaces thereof, said Y-shaped channels in each of said segments being adapted to overlie one another to define a Y-shaped tunnel;

means for securing said first and second segments to one another to form an aerodynamic floatation device;

first and second safety lines being partially positioned within said Y-shaped tunnel, each of said lines including a diverging end portion, each of said diverging end portions being positioned in a loop and extending outwardly from opposing sides of said floatation device, each of said diverging end portions further terminating in an end fixedly secured within said floatation device, each of said loops defining an opening, and means for enlarging and reducing the diameter of said opening in each of said loops.

16. The water rescue device of claim 15 wherein said floatation device is comprised of a rigid polymeric material.

17. The water rescue device of claim 16 wherein said floatation device is football-shaped.

18. The water rescue device of claim 15 wherein said enlarging an reducing means comprises each of said lines being slidably positioned within said tunnel in said floatation device so that said openings in said loops are reduced as said lines are pulled outwardly from said floatation device and said openings in said loops are enlarged as said lines are pulled inwardly toward said floatation device.

19. The water rescue device of claim 15 further including locking means for locking said loops in a fixed position.

20. The water rescue device of claim 19 wherein said locking means includes:

a fixed bar member secured to at least one of said lines, said fixed bar member including a plurality of teeth and a plurality of notches, and a spring biased bar member mounted in said floatation device, said spring biased bar member including a plurality of teeth and a plurality of notches, each of said notches positioned adjacent two of said teeth;

said teeth in said fixed bar member being adapted to engage said notches in said spring biased bar member.

* * * * *